US011619444B2

(12) United States Patent
Bollinger

(10) Patent No.: US 11,619,444 B2
(45) Date of Patent: Apr. 4, 2023

(54) LUMBER DRYING KILN INCLUDING BIDIRECTIONAL PUSH-PULL AIR CIRCULATION

(71) Applicant: BOLDESIGN INC., Hudson, NC (US)

(72) Inventor: Brett Howard Bollinger, Lenoir, NC (US)

(73) Assignee: BOLDESIGN INC., Hudson, NC (US)

( * ) Notice: Subject to any disclaimer, the term of this patent is extended or adjusted under 35 U.S.C. 154(b) by 144 days.

(21) Appl. No.: 17/142,649

(22) Filed: Jan. 6, 2021

(65) Prior Publication Data

US 2022/0214105 A1 Jul. 7, 2022

(51) Int. Cl.

| | |
|---|---|
| ***F26B 3/04*** | (2006.01) |
| ***F26B 21/02*** | (2006.01) |
| ***F26B 9/06*** | (2006.01) |
| ***F26B 21/08*** | (2006.01) |

(52) U.S. Cl.

CPC ..... *F26B 3/04* (2013.01); *F26B 9/06* (2013.01); *F26B 21/02* (2013.01); *F26B 21/08* (2013.01); *F26B 2210/16* (2013.01)

(58) Field of Classification Search

CPC .... F26B 3/04; F26B 21/02; F26B 9/06; F26B 21/08; F26B 21/221016

USPC ..... 34/396

See application file for complete search history.

(56) References Cited

U.S. PATENT DOCUMENTS 1,437,385 A * 11/1922 Mueller ..... F26B 15/00 34/518
1,466,518 A * 8/1923 Thelen ..... F26B 15/00 34/223
3,131,034 A 4/1964 Marsh
3,659,352 A * 5/1972 Cook ..... F26B 9/06 34/191
4,098,008 A 7/1978 Schuette
4,955,146 A 9/1990 Bollinger
5,325,604 A * 7/1994 Little ..... G05D 22/02 34/493
5,836,086 A * 11/1998 Elder ..... F26B 3/04 34/396
5,979,074 A * 11/1999 Brunner ..... F26B 5/04 34/396
6,219,937 B1 * 4/2001 Culp ..... F26B 21/02 432/103
7,748,137 B2 * 7/2010 Wang ..... A01G 9/243 34/396

(Continued)

FOREIGN PATENT DOCUMENTS

CA 2847005 A1 * 6/2014 ..... F26B 15/00

*Primary Examiner* — Stephen M Gravini

(74) *Attorney, Agent, or Firm* — Christopher C. Dremann, P.C.; Christopher C. Dremann

(57) ABSTRACT

A lumber drying kiln includes a first fan assembly located on a first side wall of the kiln and a second fan assembly located on a second side wall opposite the first side wall. The kiln defines an interior drying chamber and the fan of the first fan assembly is operable to push air through the drying chamber while the fan of the second fan assembly is operable to pull air through the drying chamber. The kiln further includes a first vent assembly disposed on the first side wall of the kiln and a second vent assembly disposed on the second side wall of the kiln. The first vent assembly is operable to exhaust air from inside the drying chamber while the second vent assembly is operable to intake air from the outside ambient atmosphere into the drying chamber. The kiln provides a method for seasoning and conditioning wood.

20 Claims, 4 Drawing Sheets

(56) References Cited

U.S. PATENT DOCUMENTS

| | | | | |
|---|---|---|---|---|
| 7,963,048 | B2 | 6/2011 | Pollard | |
| 8,201,501 | B2 | 6/2012 | Tinsley et al. | |
| 8,342,102 | B2 | 1/2013 | Tinsley et al. | |
| 8,857,074 | B2 * | 10/2014 | Bernon | B27K 5/0085 34/396 |
| 8,875,414 | B2 * | 11/2014 | Blomquist | F26B 25/08 34/396 |
| 9,052,140 | B2 | 6/2015 | Blomquist | |
| 9,482,465 | B2 | 11/2016 | Blomquist | |
| 9,651,308 | B1 * | 5/2017 | Lewis | F26B 21/04 |
| 9,709,328 | B2 | 7/2017 | Blomquist | |
| 9,746,240 | B2 | 8/2017 | Rivera et al. | |
| 9,964,359 | B2 | 5/2018 | Blomquist | |
| 10,161,678 | B2 | 12/2018 | Blomquist | |
| 10,203,156 | B2 | 2/2019 | Blomquist | |
| 10,619,921 | B2 * | 4/2020 | Brodie | F26B 25/12 |
| RE48,227 | E * | 9/2020 | Ball, Jr. | F26B 21/004 |
| 11,150,018 | B1 * | 10/2021 | Nichols | F26B 21/004 |
| 2006/0272172 | A1 | 12/2006 | Pollard | |
| 2007/0044341 | A1 | 3/2007 | Pollard | |
| 2011/0056087 | A1 | 3/2011 | Tinsley et al. | |
| 2012/0227276 | A1 | 9/2012 | Tinsley et al. | |
| 2019/0234686 | A1 | 8/2019 | Brodie et al. | |
| 2022/0214105 | A1 * | 7/2022 | Bollinger | F26B 3/04 |

* cited by examiner

LUMBER DRYING KILN INCLUDING BIDIRECTIONAL PUSH-PULL AIR CIRCULATION

FIELD OF THE INVENTION

The present invention relates generally to apparatus, devices and methods for conditioning and seasoning wood, for example sawed lumber. More particularly, the invention is a lumber drying kiln including a bidirectional push-pull air circulation system, and a method of drying lumber utilizing bidirectional push-pull air circulation.

BACKGROUND OF THE INVENTION

Forced air circulation chambers for drying wood, and in particular forced air circulation kilns for conditioning and seasoning sawed lumber, are well known in the art. Newly cut lumber contains varying amounts of moisture ranging from about 30% to more than about 200% depending on the species of the wood and other factors. The dimensional stability and strength of the lumber will vary as a function of the moisture content of the wood. Thus, it is necessary to reduce the moisture content of cut lumber to ensure greater dimensional stability and strength, as well as to reduce transportation costs. Lowering the moisture content of cut wood is commonly referred to as curing. The two most common methods of curing cut wood are known as the air-dry plus kiln-dry method and the kiln-dry method. The primary difference between the two methods is that the air-dry plus kiln-dry method uses the additional step of exposing the cut wood to the moisture reducing capability of the natural environment for a suitable period of time prior to introducing the wood into a drying kiln to further dry the wood to the desired moisture content. Conversely, the kiln-dry method of curing may be used with or without the initial air-dry step.

In the kiln-dry method, cut lumber is stacked onto movable racks or kiln trucks and moved into a drying chamber of the kiln for conditioning and seasoning the lumber. The cut lumber is removed from the drying chamber on the movable racks or kiln trucks once the lumber has the desired moisture content. The ambient temperature and the relative humidity of the air within the drying chamber of the kiln are maintained according to a predetermined schedule to reduce the moisture content of the lumber to an amount desirable for the final use of the lumber, typically between about 6% and about 19%. The kiln-dry method is less time consuming and more controllable than the air-dry plus kiln-dry method or air-drying alone. However, the kiln-dry method is significantly more costly than air-drying alone due to the cost of constructing, operating and maintaining a lumber drying kiln. The lumber drying kiln must be constructed large enough to accommodate large amounts of cut lumber at the same time and the interior walls of the drying chamber must be suitably insulated to prevent excessive loss of heat during operation of the kiln. In addition, the electricity required to operate the large capacity fans and to produce steam for heating the air in the drying chamber is expensive. Furthermore, the moisture-rich environment inside the kiln results in high costs to maintain the components of the air circulation system and the heat and humidity generating equipment that are located within the kiln.

U.S. Pat. No. 3,131,034 issued to Marsh discloses a lumber drying kiln of conventional construction. The kiln 10 taught by Marsh utilizes a forced air circulation system including a plurality of reversible fans 33 spaced along a lengthwise platform 30 situated centrally above the stacked lumber 28. Each of the fans 33 is operated by a separate drive shaft 34 actuated by a dedicated motor 35. Due to the high-temperature, high-humidity environment inside the kiln, the drive motors 35 are located outside the kiln supported on an exterior side wall of the kiln. The extensive length of the drive shafts 34 between the drive motors 35 and the fans 33 exacerbates the complexity and cost of construction, as well as the operating expense and the maintenance expense of the air circulation system. The Marsh kiln 10 is further provided with two lengthwise rows of vents 47, 48 that alternately admit air from the outside environment into the kiln 10 and exhaust the air inside the kiln 10 to the outside environment. The large number of vents 47, 48 contributes adversely to the complexity and cost of construction of the kiln 10. In addition, the location of the fans 47, 48 allows a significant portion of the airflow from the fans 33 heated by the heat transfer coil units 36 to be exhausted from the kiln 10 before passing through the stacked lumber 28.

The fans and motors of conventional lumber drying kilns have been located above the cut lumber in an attic area of the kiln. Consequently, it has become accepted practice to construct a separate room in the attic of the kiln for housing the air circulation system isolated from the drying chamber. An isolated room for the air circulation system is particularly advantageous when the fans, motors and associated controls are co-located in the attic of the kiln. U.S. Pat. No. 4,098,008 issued to Schuette et al. discloses a lumber drying kiln having bidirectional air flow with unidirectional fan rotation. The Schuette kiln teaches a separate air control room 16 formed in the attic of the kiln building structure. The air control room 16 houses a plurality of unidirectional rotation fans 45, 47 fixed to a common lengthwise drive shaft 50 mounted in bearing units 51 supported by the floor 39 of the control room 16. The drive shaft 50 is driven by a motor 52 located in a room 54 similarly isolated from the drying chamber. While isolating the air circulation system from the high-temperature and high-humidity environment of the drying chamber has proven advantageous, providing a separate air control room 16 in the attic of the kiln unnecessarily increases the complexity and cost of construction. Furthermore, the additional length of the lengthwise drive shaft 50 extending between the fans 45, 47 and the motor 52 reduces operating efficiency, thereby increasing operating cost, and leads to higher maintenance and repair cost due to the increased vibration of the longer drive shaft.

The disadvantages of conventional lumber drying kilns resulting from the large number of vents located on the roof of the kiln, the portion of the total airflow from the fans being exhausted from the kiln before passing through the cut lumber in the drying chamber, and the extensive length of the lengthwise drive shaft have been largely overcome by the kiln disclosed in U.S. Pat. No. 4,955,146 issued to Bollinger. The Bollinger kiln includes a drying chamber 10 and a prefabricated, self-enclosed assembly 28 positioned adjacent the roof 14 of the kiln for treating and circulating the air within the drying chamber 10. The air treating and circulating assembly 28 includes a series of reversible fans 32 for circulating the air, coils 24 for heating the air, and humidifying means 36 for increasing the humidity of the air. A fan drive motor 31 connected in series to the fans 32 by a drive means 35 is located in a fan motor assess room 60 that is separated from the air treating and circulating assembly 28 and the drying chamber 10. Ventilators 90, 92 are provided in opposite vertical walls (i.e. front and rear) of the drying chamber 10 to selectively exhaust humid air out of the drying chamber and simultaneously intake fresh air from the outside environment into the drying chamber 10. The ventilator 92 (and optionally ventilator 90) is powered by a motor 130 for exhausting the moisture-laden humid air out of the drying chamber 10 downstream from the cut lumber and upstream of the air treating and circulating assembly 28.

Despite the advances provided by the Bollinger kiln, conventional lumber drying kilns remain relatively complex, as well as time-consuming and costly to construct. It remains apparent that a need exists for an improved apparatus, device and method for reducing the complexity and cost of a lumber drying kiln, while at the same time increasing the moisture removing efficiency of the kiln. A particular need exists for a lumber drying kiln that does not utilize a large number of fans located above the cut lumber, thereby requiring one or more drive shafts having an extensive length. A further particular need exists for a lumber drying kiln that includes an exhaust system located downstream of the cut lumber and upstream of any means for increasing the ambient temperature and/or the relative humidity of the air circulation within the drying chamber.

Certain aspects, objects, features and advantages of the present invention will be made apparent, or will be readily understood and appreciated by those skilled in the relevant art, as exemplary embodiments of the invention illustrated in the accompanying drawing figures are described in greater detail. It is intended that all such aspects, objects, features and advantages of the inventions envisioned by this disclosure of exemplary embodiments be encompassed by the broadest reasonable interpretation of the appended claims construed in accordance with the ordinary meaning of their terms as understood by one of ordinary skill in the art at the time of the invention. These aspects, objects, features and advantages of the inventions, as well as others not expressly disclosed, may be accomplished by any or all of the exemplary embodiments described herein and illustrated in the accompanying drawing figures. Nevertheless, it should be appreciated that the drawing figures are for illustration purposes only, and that many modifications, changes, revisions and substitutions may be made to any of the exemplary embodiments without departing from the general concepts of the invention and the broadest reasonable interpretation of the claims given the ordinary meaning of the claim terms.

BRIEF DESCRIPTION OF THE DRAWINGS

The aforementioned aspects, objects, features and advantages of the present invention will be more fully understood and appreciated when the following detailed description of exemplary embodiments of the invention is considered in conjunction with the accompanying drawing figures, wherein like reference characters designate the same or similar parts throughout the several views.

DETAILED DESCRIPTION OF EXEMPLARY EMBODIMENTS OF THE INVENTION

Figure 1:
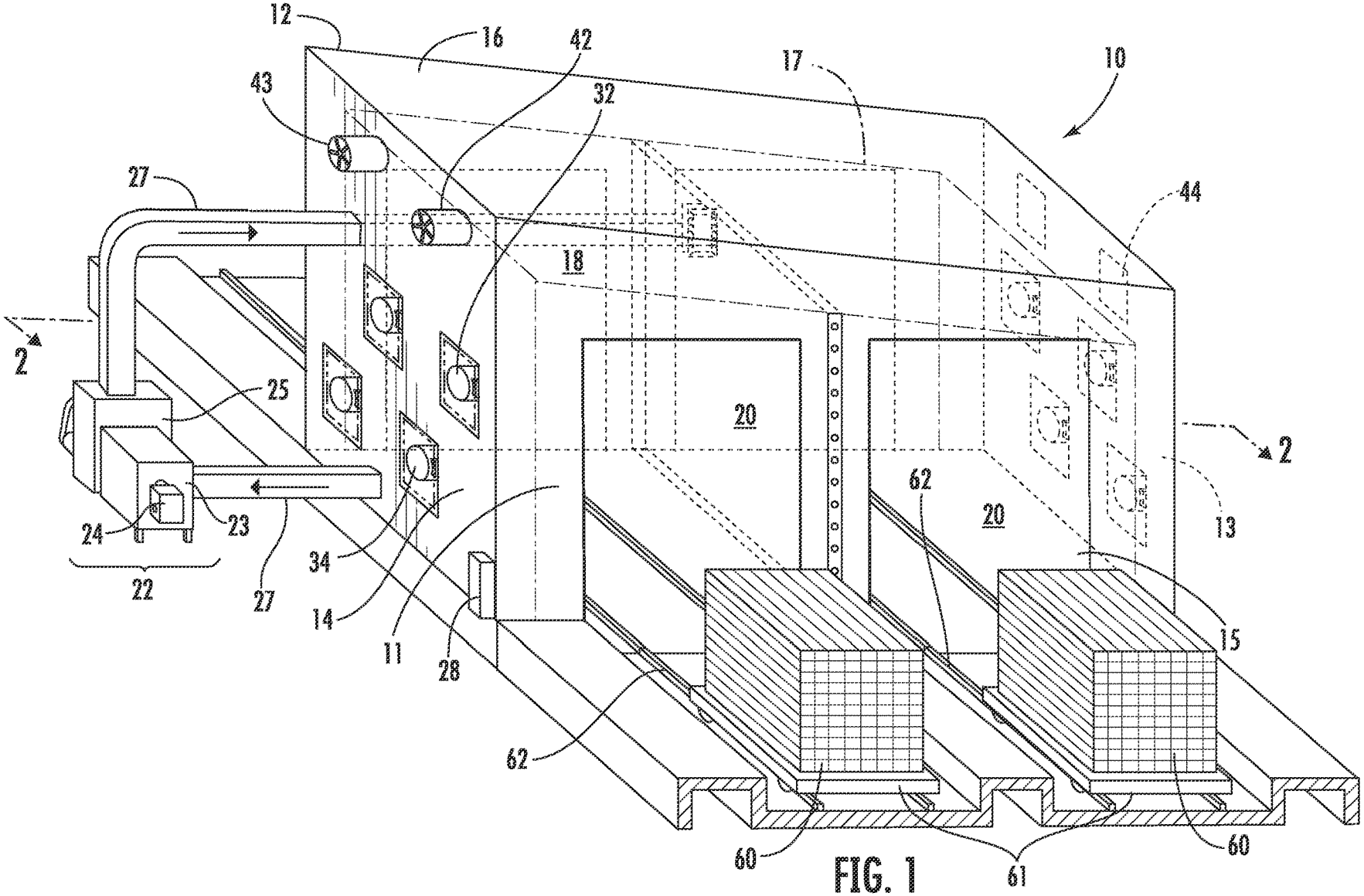
FIG. 1 is an environmental perspective view showing a lumber drying kiln constructed according to an exemplary embodiment of the invention.

FIG. 1 is an environmental perspective view of a lumber drying kiln, indicated generally by reference character 10, constructed in accordance with an exemplary embodiment of the present invention. The lumber drying kiln 10 comprises a relatively large, generally cuboid, building structure defining an interior drying chamber 20. The kiln 10 comprises a front wall 11, a rear wall 12 that is opposite the front wall 11, a right-hand side wall 13 as viewed from the front and a left-hand side wall 14 likewise as viewed from the front that is opposite the left-hand side wall 13. The front wall 11 has one or more openings covered by a door operable to be opened to load wood, such as the cut and stacked lumber 60 shown herein, to be conditioned and seasoned by drying to remove moisture, commonly referred to as curing. The lumber 60 is loaded into the drying chamber 20 of the kiln 10 through the at least one opening provided on the front wall 11 of the kiln 10, as illustrated in FIG. 1. After loading, the door is closed over the opening during the curing process. Upon completion of the curing process, the door is opened again and the cured lumber 60 is removed through the opening provided on the front wall 11. Alternatively, the cured lumber 60 may pass lengthwise through the drying chamber 20 and exit a corresponding opening provided on the rear wall 12. The foregoing process is preferable for use with track kilns 10 and a relatively short (e.g. 20 hours) drying cycle schedule at relatively high temperatures (e.g. 250° F.).

The kiln 10 further comprises a floor 15 and a roof 16 joining together the front wall 11, the rear wall 12, the side wall 13 and the side wall 14 to form the generally cuboid building. As shown and described herein, the drying chamber 20 within the kiln 10 further comprises a top wall 17 such that a space, referred to herein as an attic 18, is defined between the top wall 17 of the drying chamber 20 and the roof 16 of the lumber drying kiln 10. Also, the front wall 11 and the rear wall 12 of the kiln 10 are preferably quadrilateral shaped, as opposed to rectangular shaped, such that the right-hand side wall 13 defines a low side and the left-hand side wall 14 defines a high side of the kiln 10. In one embodiment, the building has a depth between the front wall 11 and the rear wall 12 of about 38 feet, a width between the right-hand side wall 13 and the left-hand side wall 14 of about 38 feet, and a height between the floor 15 and the roof 16 of about 20 feet at the low side wall 13 and about 24 feet at the high side wall 14 of the kiln 10. However, the dimensions of the building may be lesser or greater as desired depending on the characteristics of the wood to be conditioned and seasoned.

As best shown in FIG. 1, a heat generating system 22 is provided adjacent the left-hand side wall 14 for generating and delivering heated air into the kiln 10. The heat generating system 22 may be any suitable means for supplying heated air to the kiln 10. By way of example and not limitation, the heat generating system 22 may comprise a conventional hot air blend box 23 having a burner control 24, a blower 25 having an internal blower fan (not shown), a blower motor 26 (FIG. 2) for operating the blower fan, and ductwork 27 for delivering heated air into the attic 18 of the kiln 10 and returning moisture-laden air from the kiln 10 to the hot air blend box 23 of the heat generating system 22. An electrical panel and controller 28 may also be positioned along the side wall 14 for providing electrical power and controls to the heat generating system 22, as well as to an air circulation system 30 and an air venting system 40 of the kiln 10, both of which will be described in greater detail hereafter.

Figure 2:
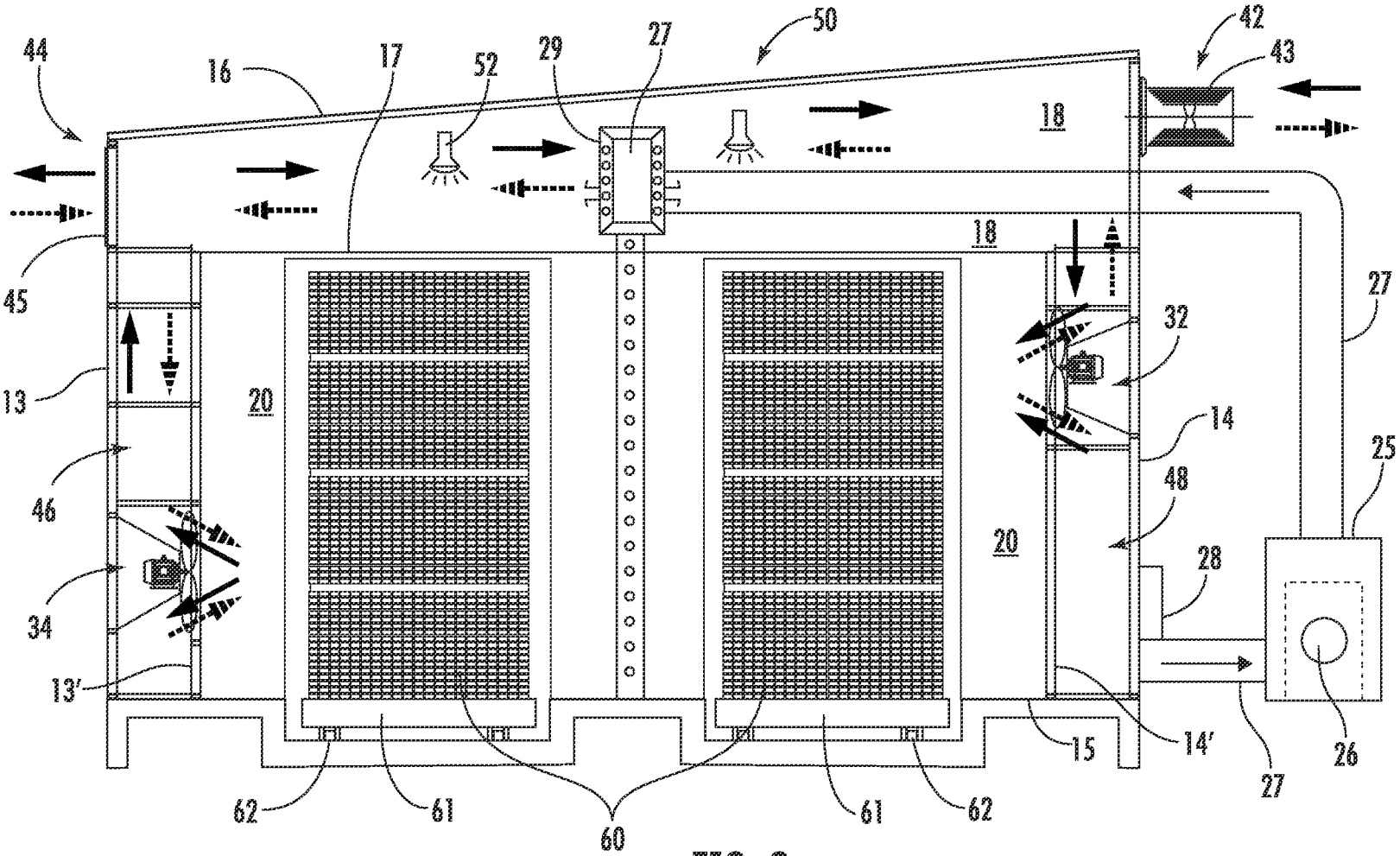
FIG. 2 is a lateral (side-to-side) cross-section view taken in the direction of arrows 2-2 of FIG. 1 showing the interior of the lumber drying kiln.

FIG. 2 is a lateral (side-to-side) cross-section view showing the interior of the lumber drying kiln 10. Specifically, the cross-section is taken through a staggered vertical plane extending from the floor 15 to the roof 16 of the kiln 10 and looking from the rear wall 12 in the direction of the front wall 11, as indicated by the arrows 2-2 in FIG. 1. The staggered vertical plane passes through an upper circulation assembly 32 of the air circulation system 30 located adjacent the left-hand side wall 14 of the kiln 10, and a lower circulation assembly 34 of the air circulation system 30 located adjacent the right-hand side wall 13 of the kiln 10. The staggered vertical plane that defines the cross-section of FIG. 2 also passes through a powered vent assembly 42 of the air venting system 40 located adjacent the side wall 14 of the kiln 10, and a non-powered vent assembly 44 of the air venting system 40 located adjacent the side wall 13 of the kiln 10. The powered vent assembly 42 for example may comprise a conventional reversible fan and motor assembly 43 disposed within a suitable opening formed in the left-hand side wall 14 in a manner known to those skilled in the art. The non-powered vent assembly 44 for example may comprise a conventional louvered vent or door 45 (FIG. 2) configured to be opened and closed and disposed within the right-hand side wall 13 in a manner known to those skilled in the art. The function and operation of the circulation assemblies 32, 34 and the vent assemblies 42, 44 will be described in greater detail hereafter.

FIG. 2 further shows a conventional heat exchanger 29 of the heat generating system 22 that is located within the attic 18 of the kiln 10. The heat exchanger 29 is in fluid communication with the ductwork 27 of the heat generating system 22 and extends longitudinally through at least a portion of the attic 18 between the front wall 11 and the rear wall 12 of the kiln 10. Heat exchanger 29 includes conventional heat down-comers that extend downwardly from the attic 18 through the top wall 17 to the floor 15 of the kiln 10 adjacent the cut and stacked lumber 60 in a manner know to those skilled in the art. FIG. 2 further shows an optional air humidifying system 50 located within the attic 18 of the kiln 10. The air humidifying system 50 may comprise any suitable means for increasing the relative humidity of the air within the kiln 10. By way of example and not limitation, the air humidifying system 50 may comprise one or more spray nozzles 52 operable for emitting moisture in the form of water vapor or water droplets into the airstream circulating through the attic 18 of the kiln 10. The heat exchanger 29 and the air humidifying system 50 are conventional components that form no part of the present invention, and their function and operation is well known to those skilled in the art.

As FIG. 2 illustrates, one or more loads of the cut and stacked lumber 60 are loaded into the drying chamber 20 of the kiln 10 to be conditioned and seasoned. The lumber 60 may be loaded into the interior drying chamber 20 in any suitable manner. By way of example and not limitation, the lumber 60 may be oriented longitudinally and stacked vertically in horizontal rows onto a conventional lumber cart 61. Each lumber cart 61 is then passed through the opening defined by the front wall 11 into the drying chamber 20 of the kiln 10. Any number of lumber carts 61 may be utilized depending on the overall dimensions of the lumber 60 and the interior dimensions of the drying chamber 20. For example, in the embodiment illustrated by FIG. 2 it is envisioned that a total of six (6) lumber carts 61 having stacked lumber 60 will be loaded into the drying chamber 20 of the kiln 10 arranged in three (3) longitudinally spaced sets of two (2) laterally spaced lumber carts 61. However, any desired number of lumber carts 61 may be arranged in any desired manner without departing from the broad concepts and intended scope of the present invention. In advantageous embodiments, the lumber carts 61 are movably disposed on kiln tracks 62 in a manner know to those skilled in the art for ease of movement into and out of the lumber drying kiln 10.

Once the lumber 60 is loaded into the drying chamber 20 of the kiln 10, the heat generating system 22 is activated to generate and deliver heat, preferably in the form of steam, through the ductwork 27 to the heat exchanger 29 and then downwardly to the heat down-comers in the interior drying chamber 20. At the same time, the air circulation system 30 is activated to circulate air within the kiln 10 in a manner to be described hereafter. The air venting system 40 may also be activated as necessary to exhaust moisture-laden air from the kiln 10 and simultaneously intake fresh air from the outside ambient atmosphere into the kiln 10 to replenish the exhausted air. In addition, the air humidifying system 50 may be activated as necessary to introduce moisture into the kiln 10 and thereby increase the relative humidity of the air circulating within the kiln 10. As known and understood by those skilled in the art, the heat generating system 22, the air circulation system 30, the air venting system 40 and the air humidifying system 50 operate to regulate the temperature, velocity, pressure and relative humidity of the air circulating within the drying chamber 20 according to a predetermined curing schedule, and thereby efficiently reduce the moisture content of the lumber 60 to an amount near that desired for the end use.

In the embodiment illustrated by FIG. 1, a pair of the upper circulation assemblies 32 and a pair of the lower circulation assemblies 34 are disposed on each of the right-hand side wall 13 and the left-hand side wall 14 of the kiln 10. Preferably, the pair of upper circulation assemblies 32 is staggered relative to the pair of lower circulation assemblies 34 on each of the side wall 13 and the side wall 14. Furthermore, a pair of the powered vent assemblies 42 is disposed on the left-hand side wall 14 above and in alignment with the corresponding pair of lower circulation assemblies 34. Similarly, a pair of the non-powered vent assemblies 44 is disposed on the right-hand side wall 13 above and in alignment with the corresponding pair of lower circulation assemblies 34. The solid arrows depicted in FIG. 2 illustrate the direction of air circulation within the kiln 10 during the curing process when the upper circulation assemblies 32 and the lower circulation assemblies 34 operate to circulate the air clockwise, as viewed from the rear towards the front of the kiln 10. Conversely, the broken arrows depicted in FIG. 2 illustrate the direction of air circulation within the kiln 10 when the upper circulation assemblies 32 and the lower circulation assemblies 34 operate to circulate the air counter-clockwise, as viewed from the rear towards the front of the kiln 10.

It should be noted in particular that with either direction of air circulation, the upper and lower circulation assemblies 32 and 34 operate together to simultaneously both push and pull air through the cut and stacked lumber 60 within the drying chamber 20 of the kiln 10. When the kiln 10 is operated to circulate air in the direction depicted by the solid arrows, the circulation assemblies 32 and 34 disposed on the side wall 14 serve to push the air through the lumber 60 within the drying chamber 20, while the circulation assemblies 32 and 34 disposed on the side wall 13 serve to pull the air through the lumber 60 within the drying chamber 20. Conversely, when kiln 10 is operated to circulate air in the direction depicted by the broken arrows, the circulation assemblies 32 and 34 disposed on the side wall 13 serve to push the air through the lumber 60 within the drying chamber 20, while the circulation assemblies 32 and 34 disposed on the side wall 14 serve to pull the air through the lumber 60 within the drying chamber 20.

It should be further noted in particular that when the kiln 10 is operated to circulate air in the direction depicted by the solid arrows, the powered vent assemblies 42 disposed on the side wall 14 serve to intake fresh air from the outside ambient atmosphere into the kiln 10, while the non-powered vent assemblies 44 disposed on the side wall 13 serve to exhaust moisture-laden air out of the kiln 10 into the outside ambient atmosphere. Conversely, when the kiln 10 is operated to circulate air in the direction depicted by the broken arrows, the powered vent assemblies 42 disposed on the side wall 14 serve to exhaust moisture-laden air out of the kiln 10 into the outside ambient atmosphere, while the non-powered vent assemblies 44 disposed on the side wall 13 serve to intake fresh air from the outside ambient atmosphere into the kiln 10. Consequently, in either direction of circulation, moisture-laden air is exhausted from the kiln 10 after passing through the lumber 60 and before passing by the heat exchanger 29 of the heat generating system 22 and the optional air humidifying system 50. In particular, the moisture-laden air is exhausted downstream of the lumber 60 and upstream of the heat exchanger 29 of the heat generating system 22 and the air humidifying system 50, thereby reducing maintenance costs. Conversely, fresh air from the outside ambient atmosphere is introduced into the kiln 10 to replenish the exhausted air before passing through the lumber 60.

Figure 3:
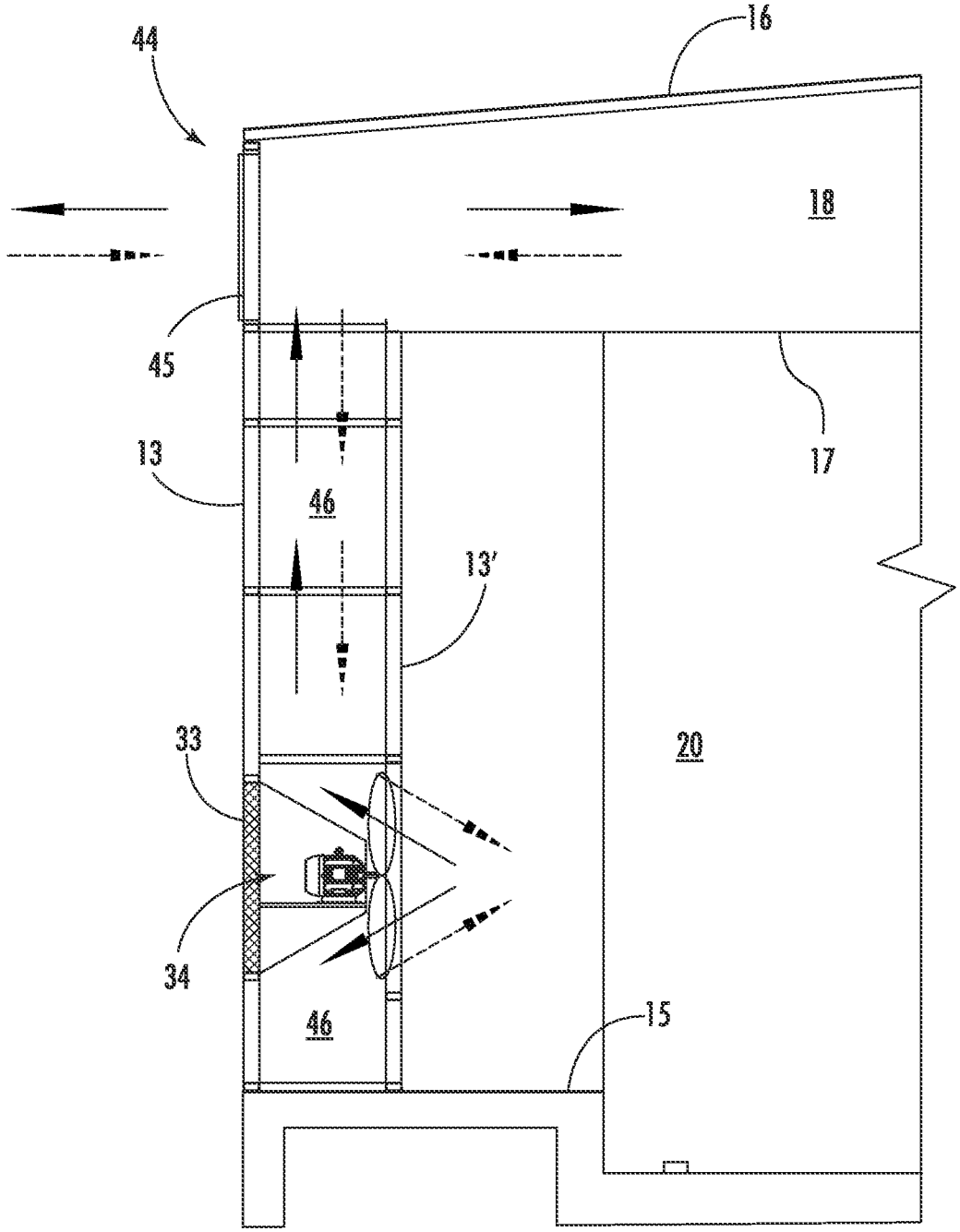
FIG. 3 is an enlarged partial view taken from FIG. 2 showing a portion of the right-hand side of the lumber drying kiln.

FIG. 3 is an enlarged partial view taken from the lateral cross-section of FIG. 2 showing a portion of the right-hand side of the kiln 10, as viewed from the rear in the direction of the front of the kiln 10. FIG. 2 and FIG. 3 show a generally hollow enclosure 46 defined by right-hand side wall 13 and right-hand interior wall 13' that is generally parallel and spaced inwardly of the side wall 13. Enclosure 46 is closed at its lower end by a portion of floor 15. Enclosure 46 is open, or is at least partially open, at its upper end by a portion of top wall 17, and is open at a portion of interior wall 13' opposite upper and lower circulation assemblies 32 and 34. Thus, the enclosure 46 allows air to be circulated between drying chamber 20, enclosure 46 and attic 18 in the direction indicated by the solid arrows, and between attic 18, enclosure 46 and drying chamber 20 in the direction indicated by the broken arrows. FIG. 2 and FIG. 3 show a similar enclosure 48 provided on the opposite side of the kiln 10 defined by left-hand side wall 14 and left-hand interior wall 14' that is generally parallel and spaced inwardly of the side wall 14. Enclosure 48 is likewise closed by a portion of floor 15, open or at least partially open by a portion of top wall 17, and open at a portion of interior wall 14' opposite upper and lower circulation assemblies 32 and 34. Thus, enclosure 48 allows air to be circulated between drying chamber 20, enclosure 48 and attic 18 in the direction indicated by the broken arrows, and between attic 18, enclosure 48 and drying chamber 20 in the direction indicated by the solid arrows.

As best shown in FIG. 2 and FIG. 3, the enclosures 46, 48 isolate the upper and lower circulation assemblies 32 and 34 on each side of the kiln 10 from the high temperature and high humidity environment inside the drying chamber 20. In one embodiment, the enclosures 46 and 48 containing the upper and lower circulation assemblies 32 and 34 may be pre-fabricated as a unit and mounted onto the drying chamber 20 of a new kiln to reduce fabrication and construction costs. Alternatively, the enclosures 46 and 48 may be mounted onto the right-hand and left-hand side walls 13 and 14, respectively, of an existing kiln as a retrofit to reduce the fabrication and construction costs associated with a new kiln. Alternatively, the interior walls 13' and 14' may be the side walls of the drying chamber 20 and the remaining portions of the enclosures 46 and 48 may be mounted onto the interior walls 13' and 14', respectively. Similarly, attic 18 containing heat exchanger 29 and optional air humidifying system 50 may be pre-fabricated and mounted onto the top wall 17 of the drying chamber 20 as a unit to further reduce fabrication and construction costs.

Figure 4:
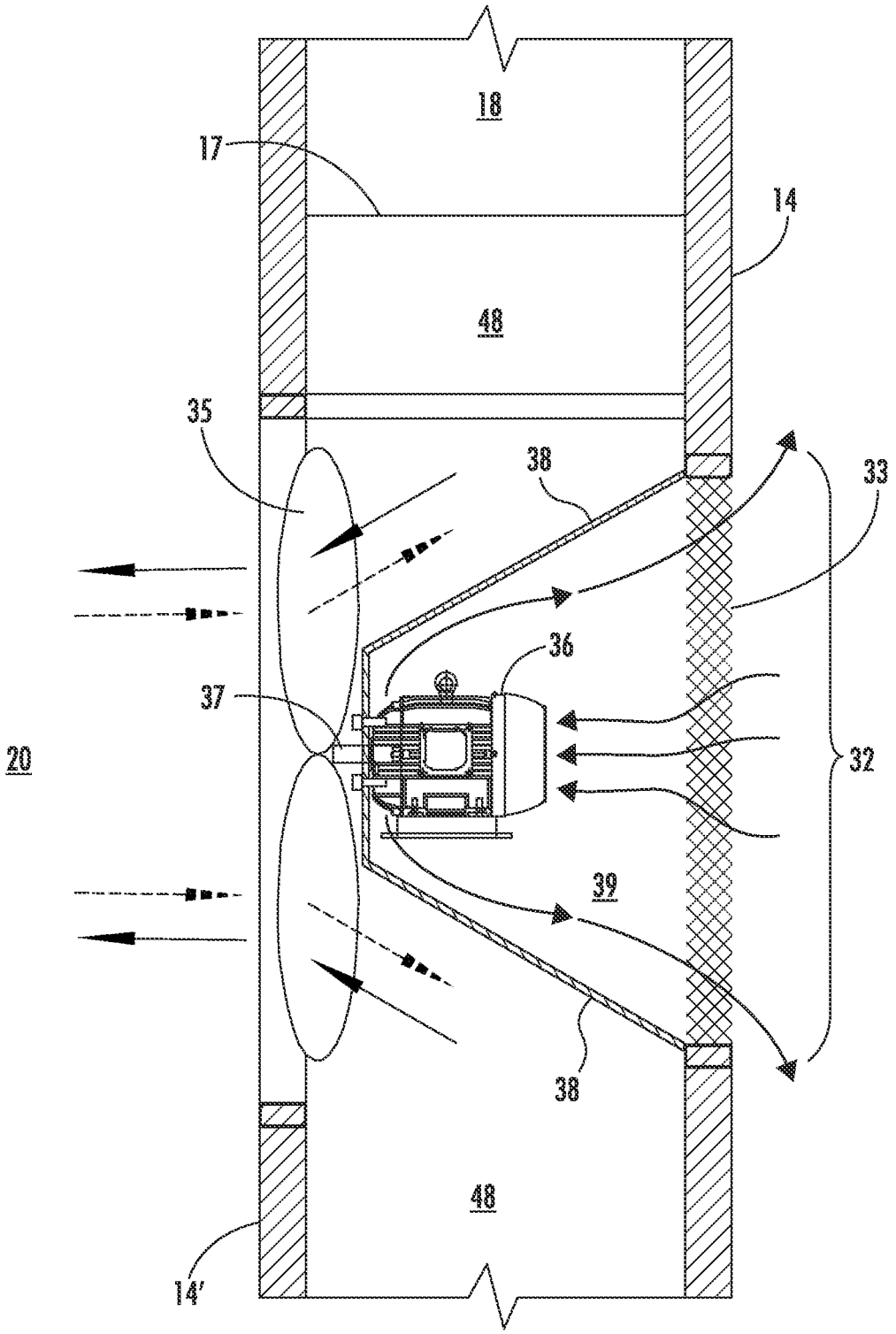
FIG. 4 is an enlarged partial view taken from FIG. 2 showing a portion of the left-hand side of the lumber drying kiln.

FIG. 4 is an enlarged partial view taken from the lateral cross-section of FIG. 2 showing an upper portion of the left-hand side of the kiln 10, as viewed from the rear in the direction of the front of the 10. Specifically, FIG. 4 shows a typical one of the upper circulation assemblies 32 in greater detail. The upper circulation assembly 32 is disposed within the enclosure 48 between the left-hand side wall 14 and the left-hand interior wall 14'. As shown and described herein, each of the upper and lower circulation assemblies 32, 34 of the air circulation system 30 comprises a reversible fan 35, a fan motor 36, a drive shaft 37 having a relatively short length that operably couples the fan 35 to the fan motor 36, and a generally conical motor housing 38 disposed between the fan 35 and the side wall 14.

The fan 35, fan motor 36 and drive shaft 37 of the circulation assemblies 32, 34 are preferably of conventional construction. However, the size (diameter) of the fan 35 and the horsepower of the fan motor 36 may be significantly reduced due to the relatively short length of the drive shaft 37, and furthermore, as a result of the increased efficiency provided by the modular design of the enclosures 46, 48 and the "push-pull" air circulation produced by the circulation assemblies 32, 34 through the lumber 60 within the drying chamber 20. In addition, the motor housing 38 defines an interior compartment 39 isolated from the heated and/or moisture-laden air within the drying chamber 20 and the enclosure 46, 48, thereby reducing maintenance and repair costs associated with the fan motor 36. If desired, an air permeable access panel, door, screen or the like 33 may be provided on the side walls 13, 14 of the kiln 10 to enclose the interior compartments 39 of the circulation assemblies 32, 34 and thereby protect the fan motor 36 from the exterior environment.

Regardless of the foregoing detailed description of exemplary embodiments of the invention, the optimum structure of the invented apparatus and system, and the manner of use, operation and steps of the invented method, as well as reasonable equivalents thereof, are deemed to be readily apparent and understood by those skilled in the art. Accordingly, equivalent relationships to those shown in the accompanying drawing figures and described in the foregoing written description are intended to be encompassed by the present invention and the appended claims given the ordinary meaning of the claim terms to those of ordinary skill in the art. As such, the foregoing description is considered as merely illustrative of the general concept and principles of the invention. Furthermore, as numerous modifications and changes will readily occur to those skilled in the art, the exemplary embodiments disclosed are not intended to limit the invention to the specific configuration, construction, materials, manner of use and operation shown and described herein. Instead, all obvious modifications and reasonably foreseeable equivalents thereof should be construed as falling within the scope of the inventions as defined by the broadest reasonable interpretation and ordinary meaning construction of the appended claims in view of the foregoing written description and accompanying drawing figures.

That which is claimed is:

1. A lumber drying kiln, comprising:

a floor, a first side wall, a first interior wall, a second side wall, a second interior wall, a top wall and a roof;

an interior drying chamber defined by the floor, the first interior wall, the second interior wall and the top wall;

a first enclosure defined by the floor, the first wall, the first interior wall and at least partially by the top wall, the first enclosure disposed adjacent the interior drying chamber;

a second enclosure defined by the floor, the second wall, the second interior wall and at least partially by the top wall, the second enclosure disposed adjacent the interior drying chamber opposite the first enclosure; and a plurality of fan assemblies each comprising a fan driven by a fan motor;

wherein a first fan assembly is disposed within the first enclosure and a second fan assembly is disposed within the second enclosure.

2. The lumber drying kiln according to claim 1, wherein the fan of the first fan assembly is operable to push air through the drying chamber while the fan of the second fan assembly is operable to pull air through the drying chamber.

3. The lumber drying kiln according to claim 2, wherein the fan of the first fan assembly and the fan of the second fan assembly are each reversible, and wherein the fan of the first fan assembly is operable to pull air through the drying chamber while the fan of the second fan assembly is operable to push air through the drying chamber.

4. The lumber drying kiln according to claim 2, further comprising an attic defined by the top wall, the first side wall, the second side wall and the roof, and a plurality of vent assemblies disposed within the attic, and wherein a first vent assembly is disposed on the first side wall of the kiln and a second vent assembly is disposed on the second side wall of the kiln.

5. The lumber drying kiln according to claim 4, wherein the first vent assembly is operable to exhaust air from inside the drying chamber while the second vent assembly is operable to intake air from the outside ambient atmosphere into the drying chamber.

6. The lumber drying kiln according to claim 2, further comprising an attic defined by the top wall, the first side wall, the second side wall and the roof, and a heat generating system having a heat exchanger disposed within the attic for supplying heated air to the drying chamber of the kiln.

7. The lumber drying kiln according to claim 6, further comprising at least a first vent assembly operable to exhaust moisture-laden air from the drying chamber before the moisture-laden air passes the heat exchanger of the heat generating system.

8. The lumber drying kiln according to claim 2, further comprising an attic defined by the top wall, the first side wall, the second side wall and the roof, and an air humidifying system disposed within the attic for increasing a relative humidity of the air within the drying chamber of the kiln.

9. The lumber drying kiln according to claim 8, further comprising at least a first vent assembly operable to exhaust moisture-laden air from the drying chamber before the moisture-laden air passes the air humidifying system.

10. The lumber drying kiln according to claim 4, wherein the first vent assembly is powered and wherein the second vent assembly is non-powered.

11. The lumber drying kiln according to claim 1, wherein the first fan assembly disposed within the first enclosure is in air circulation communication with the drying chamber and the second fan assembly disposed within the second enclosure is in air circulation communication with the drying chamber.

12. A kiln for conditioning and seasoning wood, the kiln comprising:

a front wall, a rear wall opposite the front wall, a first side wall, a first interior wall, a second side wall, a second interior wall opposite the first interior wall, a floor, a top wall opposite the floor and a roof opposite the top wall, at least the front wall having an opening for receiving wood disposed within an interior drying chamber of the kiln defined by the floor, the first interior wall, the second interior wall and the top wall; and a plurality of fan assemblies, each fan assembly comprising a fan driven by a fan motor;

wherein at least a first one of the fan assemblies is positioned within a first enclosure between the first side wall and the first interior wall adjacent the drying chamber and operates to pull air through the wood disposed within the drying chamber and at least a second one of the fan assemblies is positioned within a second enclosure between the second wall and the second interior wall adjacent the drying chamber oand operates to push air through the wood disposed within the drying chamber.

13. The kiln according to claim 12, further comprising a plurality of vent assemblies and wherein a first one of the vent assemblies operates to exhaust air from within the drying chamber and at least a second one of the vent assemblies operates to intake air from an outside ambient atmosphere into the drying chamber.

14. The kiln according to claim 12, wherein the at least a first one of the fan assemblies positioned within the first enclosure and the at least a second one of the fan assemblies positioned within the second enclosure are each in air circulation communication with the drying chamber.

15. The kiln according to claim 12, wherein the plurality of fan assemblies each comprise an interior compartment that isolates the fan motor from the air within the drying chamber.

16. The kiln according to claim 13, further comprising a heat generating system having a heat exchanger for supplying heated air to the drying chamber, and wherein the at least one of the vent assemblies exhausts moisture-laden air after passing through the wood within the drying chamber and before passing through the heat exchanger.

17. A method for seasoning and conditioning wood, comprising:

providing a kiln having a floor, a top wall, a first side wall, a first interior wall, a second side wall and a second interior wall opposite the first interior wall, the floor, the top wall, the first interior wall and the second interior wall defining an interior drying chamber that is disposed between a first enclosure adjacent the first interior wall of the drying chamber and a second enclosure adjacent the second interior wall of the drying chamber;

disposing the wood within the drying chamber;

providing a plurality of fan assemblies operable for circulating air through the drying chamber; and operating at least a first one of the fan assemblies disposed within the first enclosure to pull the air through the wood in the drying chamber while operating at least a second one of the fan assemblies disposed within the second enclosure to push the air through the wood in the drying chamber.

18. The method according to claim 17, wherein each of the fan assemblies is reversible to change a direction of the air circulating through the drying chamber.

19. The method according to claim 17, further comprising:

providing a plurality of vent assemblies; and operating at least a first one of the vent assemblies to exhaust air from within the drying chamber while operating at least a second one of the vent assemblies to intake air from an outside ambient atmosphere into the drying chamber.

20. The method according to claim 17, wherein each of the fan assemblies comprises a fan, a fan motor, a drive shaft disposed between the fan and the fan motor, and an interior compartment that isolates the fan motor from the circulating air within the drying chamber.

* * * * *